US011817045B2

(12) United States Patent
Pyo et al.

(10) Patent No.: US 11,817,045 B2
(45) **Date of Patent: *Nov. 14, 2023**

(54) DISPLAY DEVICE AND METHOD FOR DRIVING THE SAME

(71) Applicant: SAMSUNG DISPLAY CO., LTD., Yongin-si (KR)

(72) Inventors: Si Beak Pyo, Yongin-si (KR); Seung Kyu Lee, Yongin-si (KR); Min Seong Son, Yongin-si (KR)

(73) Assignee: SAMSUNG DISPLAY CO., LTD., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/054,203

(22) Filed: Nov. 10, 2022

(65) Prior Publication Data

US 2023/0068220 A1 Mar. 2, 2023

Related U.S. Application Data

(63) Continuation of application No. 16/735,134, filed on Jan. 6, 2020, now Pat. No. 11,545,073.

(30) Foreign Application Priority Data

Mar. 14, 2019 (KR) ..... 10-2019-0029451

(51) Int. Cl.
*G09G 3/32* (2016.01)
*G09G 3/20* (2006.01)

(52) U.S. Cl.
CPC ..... *G09G 3/32* (2013.01); *G09G 3/2022* (2013.01); *G09G 2310/0278* (2013.01); *G09G 2320/0646* (2013.01)

(58) Field of Classification Search
CPC ..... G09G 3/32; G09G 3/2022; G09G 2310/0278; G09G 2320/0646;
(Continued)

(56) References Cited

U.S. PATENT DOCUMENTS 9,478,166 B2 10/2016 Pyo et al.
9,501,975 B2 11/2016 Eom et al.
(Continued)

FOREIGN PATENT DOCUMENTS

KR 10-2015-0142943 12/2015
KR 10-2017-0002716 1/2017
(Continued)

OTHER PUBLICATIONS

Notice of Allowance dated Sep. 18, 2023, in corresponding Korean Patent Application No. 10-2019-0029451, 6 pages.

*Primary Examiner* — Roberto W Flores
*Assistant Examiner* — Maheen I Javed
(74) *Attorney, Agent, or Firm* — F. CHAU & ASSOCIATES, LLC

(57) ABSTRACT

A display device includes a display unit including a plurality of pixels coupled to a plurality of data lines, a plurality of scan lines, and a plurality of emission control lines, a controller for determining a width of a gate-off section of an emission control signal, which corresponds to a non-emission section of each of a plurality of frames belonging to a dimming period, in response to a dimming signal, and an emission driver for supplying the emission control signal in units of a plurality of consecutive pixel rows through the plurality of emission control lines.

15 Claims, 12 Drawing Sheets

(58) Field of Classification Search
CPC ... G09G 2320/0626; G09G 2300/0861; G09G 2310/0262; G09G 2310/0251; G09G 3/3233; G09G 3/3208; G09G 3/3266; G09G 2320/0233; G09G 2310/08; G09G 2230/00
See application file for complete search history.

(56) References Cited

U.S. PATENT DOCUMENTS

| | | | |
|---|---|---|---|
| 10,049,617 | B2 | 8/2018 | Shin et al. |
| 2014/0267454 | A1 | 9/2014 | Ikenishi |
| 2015/0364076 | A1 | 12/2015 | Park et al. |
| 2017/0069275 | A1 | 3/2017 | Sengoku et al. |
| 2017/0124958 | A1 | 5/2017 | Pyo et al. |
| 2018/0068602 | A1 | 3/2018 | Xiang et al. |
| 2018/0151132 | A1 | 5/2018 | Lee et al. |
| 2020/0294445 | A1 | 9/2020 | Pyo et al. |

FOREIGN PATENT DOCUMENTS

| | | |
|---|---|---|
| KR | 10-2017-0132401 | 12/2017 |
| KR | 10-2018-0062048 | 6/2018 |
| KR | 10-2018-0123645 | 11/2018 |

FIG. 6

| FRAME \ DIL | 4 | 5 | 6 | 7 | 8 |
|---|---|---|---|---|---|
| 1st | 4H | 8H | 8H | 8H | 8H |
| 2nd | 4H | 4H | 4H | 8H | 8H |
| 3rd | 4H | 4H | 8H | 8H | 8H |
| 4th | 4H | 4H | 4H | 4H | 8H |

2CYCLE DIMMING, E1

DISPLAY DEVICE AND METHOD FOR DRIVING THE SAME

CROSS-REFERENCE TO RELATED APPLICATION

The present application is a continuation application of U.S. patent application Ser. No. 16/735,134, filed Jan. 6, 2020, which claims priority under 35 U. S.C. § 119(a) to Korean patent application no. 10-2019-0029451, filed on Mar. 14, 2019 in the Korean Intellectual Property Office, the disclosures of which are incorporated by reference herein in their entirety.

TECHNICAL FIELD

Exemplary embodiments of the inventive concept generally relate to a display device, and more particularly, to a display device configured to control an emission control signal.

DISCUSSION OF RELATED ART

A display device includes a timing driving controller configured to control overall driving timings, a scan driver configured to provide a gate signal to pixels, a data driver configured to provide a data signal to the pixels, and an emission driver configured to provide an emission control signal to the pixels.

To implement a dimming mode of the display device, dimming techniques may change all grayscale voltages by using a grayscale at a predetermined luminance level (e.g., a maximum luminance level), may control the length of an emission section (or non-emission section) in one frame, or the like.

SUMMARY

According to an exemplary embodiment of the inventive concept, a display device includes a display unit including a plurality of pixels coupled to a plurality of data lines, a plurality of scan lines, and a plurality of emission control lines, a controller configured to determine a width of a gate-off section of an emission control signal, which corresponds to a non-emission section of each of a plurality of frames belonging to a dimming period, in response to a dimming signal, and an emission driver configured to supply the emission control signal in units of a plurality of consecutive pixel rows through the plurality of emission control lines.

The dimming signal may include information on a dimming level corresponding to display luminance of the display unit. The controller may determine a width of the gate-off section, which corresponds to a first reference dimming level, as a first width, and determines a width of the gate-off section, which corresponds to a second reference dimming level higher than the first reference dimming level, as a second width. The second width may be greater than the first width.

The width of the gate-off section, which corresponds to the first reference dimming level, may be substantially equal to the first width, and the width of the gate-off section, which correspond to the second reference dimming level, may be substantially equal to the second width.

The gate-off section of the emission control signal, which corresponds to each of dimming levels between the first reference dimming level and the second reference dimming level, may include a combination of first off sections each having the first width and second off sections each having the second width in the dimming period.

In a range between the first reference dimming level and the second reference dimming level, the number of the first off sections of the emission control signal may decrease and the number of the second off sections of the emission control signal may increase, when the dimming level increases.

The sum of a number of the first off sections included in the dimming period and a number of the second off sections included in the dimming period may be constant.

Arrangements of the first and second off sections according to a lapse of frames in the dimming period may be differently set with respect to the dimming levels.

An average width of all gate-off sections of the emission control signal, which is included in the dimming period, per frame may be equal to the width of a gate-off section, which is indicated by the dimming level.

The first width may correspond to k (where k is a multiple of 4) horizontal periods, and the second width may correspond to a k+4 horizontal periods.

The interval between the first reference dimming level and the second reference dimming level may correspond to 4 horizontal periods.

The dimming period may correspond to 4 frames.

The emission driver may output the emission control signal having i (where i is an integer greater than 1) gate-off sections corresponding to i non-emission sections in one frame.

The dimming period may correspond to 4*i frames.

The difference in dimming level between the first reference dimming level and the second reference dimming level may correspond to 4*i horizontal periods.

When the dimming level indicates k*i horizontal periods, each of the widths of the gate-off sections of the emission control signal may correspond to k horizontal periods. When the dimming level indicates (k+4)*i horizontal periods, each of the widths of the gate-off sections of the emission control signal may correspond to k+4 horizontal periods.

When the dimming level indicates horizontal periods between k*i horizontal periods and k+4*i horizontal periods, the first width may correspond to k horizontal periods, and the second width may correspond to k+4 horizontal periods.

The emission driver may substantially simultaneously supply the emission control signal to a (2n−1)th (where n is a natural number) pixel row and a 2nth pixel row.

The display device may further include a scan driver configured to sequentially supply a scan signal to the (2n−1)th pixel row and the 2nth pixel row through the plurality of scan lines.

According to an exemplary embodiment of the inventive concept, a method for driving a display device includes determining a first width of a gate-off section of an emission control signal, which is indicated by a first reference dimming level, and a second width of the gate-off section of the emission control signal, which is indicated by a second reference dimming level, determining a combination of first off sections each having the first width and second off sections each having the second width, in response to a first intermediate dimming level that is an intermediate value between the first reference dimming level and the second reference dimming level, and recombining an arrangement of the first and second off sections of the emission control signal output during the predetermined dimming period, in response to a second intermediate dimming level that is an intermediate value between dimming levels determined by the combination of the first and second off sections.

The method may further include outputting the emission control signal, corresponding to a dimming level included in a dimming signal.

According to an exemplary embodiment of the inventive concept, a method for driving a display device includes determining a first width of a gate-off section of an emission control signal, which is indicated by a first reference dimming level in a dimming period, and a second width of the gate-off section of the emission control signal, which is indicated by a second reference dimming level in the dimming period, determining a first intermediate dimming level in the dimming period that is an intermediate value between the first reference dimming level and the second reference dimming level by combining first off sections each having the first width and second off sections each having the second width, setting the first intermediate dimming level as a third reference dimming level, and determining a second intermediate dimming level in the dimming period that is an intermediate value between the first reference dimming level and the third reference dimming level by combining the first off sections and the second off sections. The second width may be greater than the first width. The sum of the number of the first off sections included in the dimming period and the number of the second off sections included in the dimming period may be constant.

BRIEF DESCRIPTION OF THE DRAWINGS

The above and other features of the inventive concept will be more fully understood by describing in detail exemplary embodiments thereof with reference to the accompanying drawings.

FIG. 6 is a conceptual diagram illustrating the output of the emission driver of FIG. 4 according to an exemplary embodiment of the inventive concept.

DETAILED DESCRIPTION OF THE EMBODIMENTS

Figure 1:
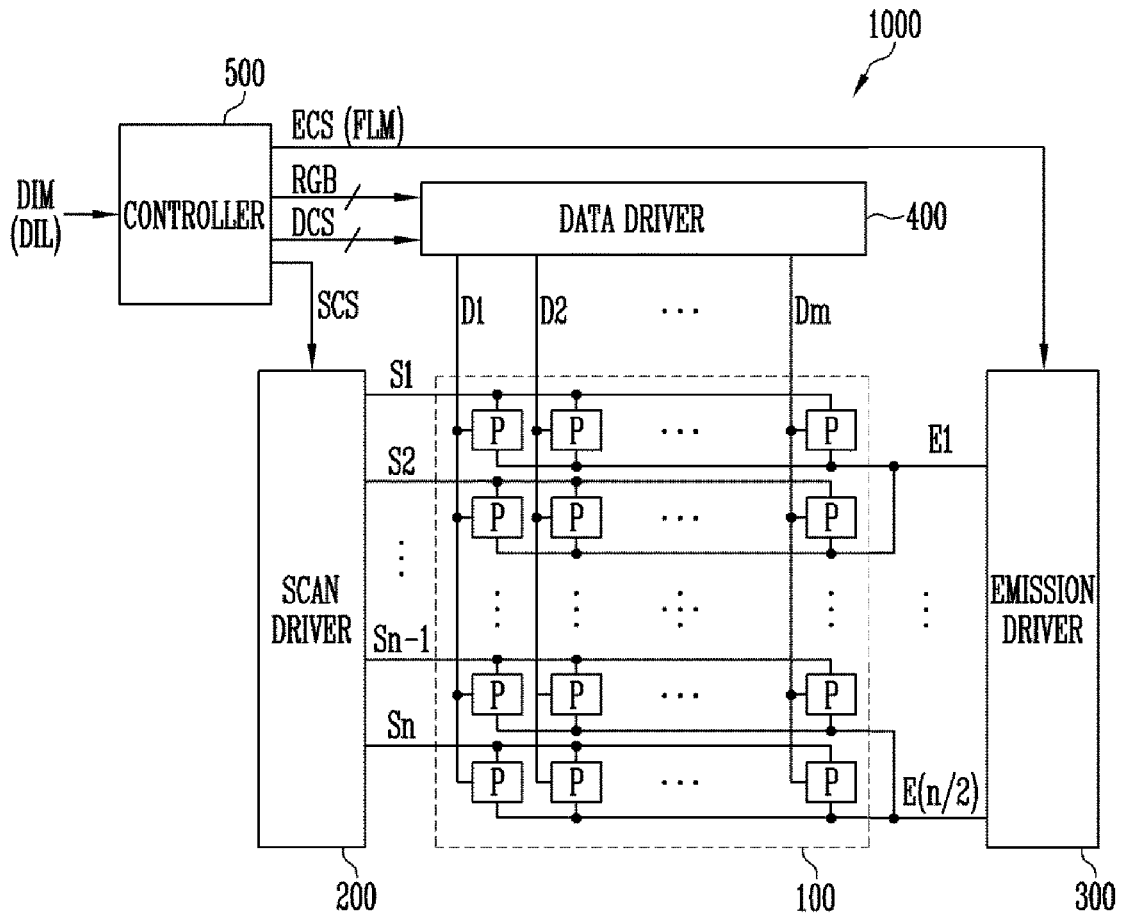
FIG. 1 is a block diagram illustrating a display device according to an exemplary embodiment of the inventive concept.

Exemplary embodiments of the inventive concept provide a display device configured to control the width of a gate-off section of an emission control signal for each frame according to a dimming level so as to implement dimming for controlling display luminance.

Hereinafter, exemplary embodiments of the inventive concept will be described in more detail with reference to the accompanying drawings. Like reference numerals may refer to like elements throughout this application.

It will be understood that when an element is referred to as being "between" two elements, it can be the only element between the two elements, or one or more intervening elements may also be present.

FIG. 1 is a block diagram illustrating a display device according to an exemplary embodiment of the inventive concept.

Referring to FIG. 1, a display device 1000 may include a display unit 100, a scan driver 200, an emission driver 300, a data driver 400, and a controller 500.

The display unit 100 may include a plurality of scan lines S1 to Sn, a plurality of emission control lines E1 to E(n/2), a plurality of data lines D1 to Dm, and a plurality of pixels P respectively connected to the scan lines S1 to Sn, the emission control lines E1 to E(n/2), and the data lines Dm (where m is an integer greater than 1, and n is an even number). Each of the pixels P may include a driving transistor and a plurality of switching transistors.

The controller 500 may determine an output off-duty (or a width of a gate-off section) of an emission control signal with respect to each of frames included in a dimming period in response to a dimming level DIL included in a dimming signal DIM. The dimming signal DIM is a signal for controlling the dimming level DIL or luminance level. The dimming level DIL may be a predetermined command value obtained by digitizing a display luminance level for dimming. In exemplary embodiments of the inventive concept, the dimming level DIL may be a command for determining a width (length) of a gate-off section of an emission control signal. For example, the dimming level DIL may indicate a total length of a gate-off section in one frame of an emission control signal to be output.

Meanwhile, in exemplary embodiments of the inventive concept, a total length of a gate-off section of an emission control signal actually output from the emission driver 300 may not correspond to that of a gate-off section, which is indicated by the dimming level DIL, according to design conditions of the emission driver 300 and the display device 1000.

In an exemplary embodiment of the inventive concept, the controller 500 may generate an emission control start signal FLM having a predetermined gate-off section in response to the dimming level DIL. The gate-off section may correspond to a length (or off-duty) of a non-emission section that the emission control signal, actually output from the emission driver 300, has in one frame (or one period). Accordingly, the width of the gate-off section of the emission control signal may increase when the input luminance level decreases (or when the dimming level DIL increases). In addition, the display luminance may increase when the dimming level DIL decreases.

The controller 500 may control the width of the gate-off section of the emission control signal in units of predetermined horizontal periods H. For example, the width of the gate-off section of the emission control signal may have horizontal periods corresponding to a multiple of 4, such as 4 horizontal periods 4H, 8 horizontal periods 8H, 12 horizontal periods 12H, or 16 horizontal periods 16H. The emission control signal does not have a gate-off section of 5 horizontal periods 5H, 6 horizontal periods 6H, or the like. Therefore, when a gate-off section completely corresponding to the dimming level DIL is not generated, accurate luminance control according to a change in dimming level DIL may be impossible.

The controller 500 controls the width of a non-emission section (or the width of a gate-off section) of each of frames included in a dimming period, to determine an output of an emission control signal corresponding to each of all dimming levels DIL. This will be described in detail with reference to FIG. 4.

In an exemplary embodiment of the inventive concept, the controller 500 may control driving of the scan driver 200, the emission driver 300, and the data driver 400. For example, the controller 500 may include a timing controller configured to control the scan driver 200, the emission driver 300, and the data driver 400.

The controller 500 may generate a first control signal SCS, a second control signal ECS, and a third control signal DCS, corresponding to synchronization signals supplied from the outside. The first control signal SCS may be supplied to the scan driver 200, the second control signal ECS may be supplied to the emission driver 300, and the third control signal DCS may be supplied to the data driver 400. Additionally, the controller 500 may realign image data supplied from the outside and supply the realigned image data to the data driver 400.

A scan start signal and clock signals may be included in the first control signal SCS. The scan start signal may control a first timing of a scan signal. The clock signals may be used to shift the scan start signal.

The emission control start signal FLM and clock signals may be included in the second control signal ECS. The emission control start signal FLM may control a first timing of an emission control signal. The clock signals may be used to shift the emission control start signal FLM.

A source start pulse and clock signals may be included in the third control signal DCS. The source start pulse may control a sampling start time of data. The clock signals may be used to control a sampling operation.

The scan driver 200 may receive the first control signal SCS from the controller 500, and supply a scan signal to the scan lines S1 to Sn, based on the first control signal SCS. For example, the scan driver 200 may sequentially the scan signal to the scan lines S1 to Sn. When the scan signal is sequentially supplied, the pixels P may be selected in units of horizontal lines (or units of pixel rows).

The scan signal may be set to a gate-on voltage (e.g., a low voltage). A transistor that is included in the pixel P and receives a scan signal may be set to a turn-on state when the scan signal is supplied.

The emission driver 300 may receive the second control signal ECS from the controller 500, and supply an emission control signal to the emission control lines E1 to E(n/2), based on the second control signal ECS. For example, the emission driver 300 may sequentially supply the emission control signal to the emission control lines E1 to E(n/2).

The emission control signal may be set to a gate-on voltage (e.g., a low voltage). A transistor that is included in the pixel P and receives an emission control signal may be turned on when the emission control signal is supplied, and be set to a turn-off state in other cases.

The emission control signal is used to control emission times of the pixels P. To this end, the emission control signal may be set to have a width wider than that of the scan signal.

In an exemplary embodiment of the inventive concept, as shown in FIG. 1, the emission driver 300 may supply the emission control signal in units of consecutive pixel rows through the emission control lines E1 to E(n/2). For example, the emission driver 300 may substantially simultaneously supply the emission control signal to a (2i−1)th (where i is a natural number) pixel row and a 2ith pixel row. In other words, the same emission control signal may be substantially simultaneously supplied to two consecutive pixel rows. Therefore, emissions of two pixel rows may be substantially simultaneously controlled. For example, during a gate-off section of one emission control signal (e.g., a section in which the emission control signal has a gate-off voltage), initialization, compensation, and data write operations on two pixel rows corresponding to the one emission control signal may be performed. However, this is merely illustrative, and one emission control line may be commonly coupled to three or more pixel rows.

Accordingly, the number of stages (or shift registers) included in the emission driver 300 can be decreased to a half or less, as compared to a configuration where one emission control line is coupled to one pixel row. As such, the area of a bezel at the periphery of the display unit 100 can be reduced.

Each of the scan driver 200 and the emission driver 300 may be mounted on a substrate through a thin film process. In addition, the scan driver 200 may be located at both sides of the display unit 100 with the display unit 100 interposed therebetween. The emission driver 300 may also be located at both sides of the display unit 100 with the display unit 100 interposed therebetween.

The data driver 400 may receive the third control signal DCS and an image data signal RGB from the controller 500. The data driver 400 may supply a data signal to the data lines D1 to Dm, corresponding to the third control signal DCS. The data signal supplied to the data lines D1 to Dm may be supplied to the pixels P selected by the scan lines S1 to Sn. To this end, the data driver 400 may supply the data signal to the data lines D1 to Dm in sync with the scan signal.

Figure 2:
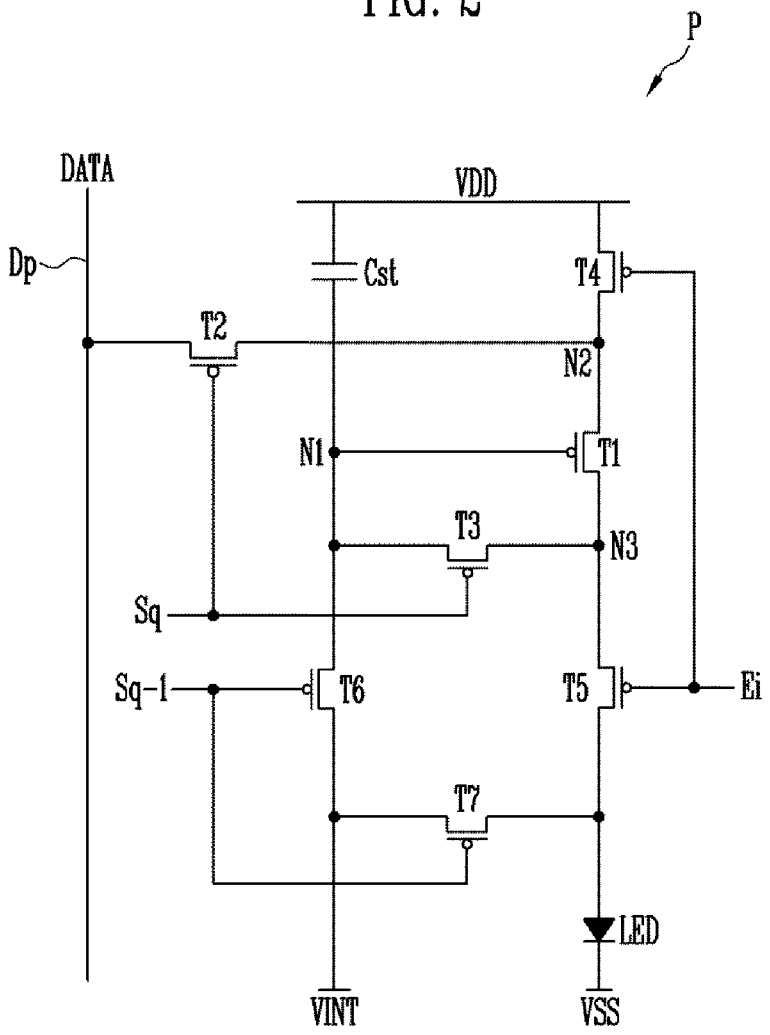
FIG. 2 is a circuit diagram illustrating a pixel included in the display device shown in FIG. 1 according to an exemplary embodiment of the inventive concept.

FIG. 2 is a circuit diagram illustrating a pixel included in the display device shown in FIG. 1 according to an exemplary embodiment of the inventive concept.

For convenience of description, the pixel P that is located on a qth horizontal line (or qth pixel row) and is coupled to a pth data line Dp is illustrated in FIG. 2 (where p and q are natural numbers).

Referring to FIG. 2, the pixel P may include a light emitting device LED, first to seventh transistors T1 to T7, and a storage capacitor Cst.

A first electrode of the light emitting device LED may be coupled to one electrode of the seventh transistor T7, and a second electrode of the light emitting device LED may be coupled to a second power source VSS. The light emitting device LED may generate light with a predetermined luminance corresponding to an amount of current (driving current) supplied from the first transistor T1. In an exemplary embodiment of the inventive concept, the light emitting device LED may be an organic light emitting diode including an organic emitting layer or an inorganic light emitting diode formed of an inorganic material.

The first transistor T1 may be coupled between a second node N2 electrically coupled to a first power source VDD and a third node N3 electrically coupled to the first electrode of the light emitting device LED. The first transistor T1 may generate the driving current and provide the generated driving current to the light emitting device LED. A gate electrode of the first transistor T1 may be coupled to a first node N1. The first transistor T1 serves as a driving transistor of the pixel P.

The second transistor T2 may be coupled between a data line (e.g., the pth data line Dp) and the second node N2. The second transistor T2 may include a gate electrode receiving a scan signal. For example, the gate electrode of the second transistor T2 may be coupled to a first scan line Sq of the qth pixel row.

The third transistor T3 may be electrically coupled between the first node N1 and the third node N3. The third transistor T3 may include a gate electrode coupled to the first scan line Sq.

The fourth transistor T4 may be coupled between the first power source VDD and the second node N2. The fourth transistor T4 may include a gate electrode receiving the emission control signal. The gate electrode of the fourth transistor T4 may be coupled to an emission control line Ei. In an exemplary embodiment of the inventive concept, the emission control line Ei may be commonly coupled to two consecutive pixel rows. For example, the emission control line Ei may be commonly coupled to a (q−1)th pixel row and the qth pixel row, and the emission control signal may be substantially simultaneously supplied to the (q−1)th pixel row and the qth pixel row.

The fifth transistor T5 may be coupled between the third node N3 and the first electrode of the light emitting device LED. The fifth transistor T5 may include a gate electrode receiving the emission control signal. The gate electrode of the fifth transistor T5 may be coupled to the emission control line Ei.

The sixth transistor T6 may be coupled between the first node N1 and an initialization power source VINT. In an exemplary embodiment of the inventive concept, the sixth transistor T6 may include a gate electrode coupled to a second scan line Sq−1 of the qth pixel row. For example, the second scan line Sq−1 may be identical to a first scan line of a previous pixel row (e.g., the (q−1)th pixel row).

The seventh transistor T7 may be coupled between the initialization power source VINT and the first electrode of the light emitting device LED. The seventh transistor T7 may include a gate electrode coupled to the second scan line Sq−1. However, this is merely illustrative, and the scan line coupled to each of the gate electrodes of the sixth and seventh transistors T6 and T7 is not limited thereto. For example, scan lines transferring a scan signal at different timings may be respectively coupled to the sixth and seventh transistors T6 and T7.

In exemplary embodiments of the inventive concept, when the fourth and fifth transistors T4 and T5 are turned on, a current flowing through the first transistor T1 may be transferred to the light emitting device LED, and the light emitting device LED may emit light. An emission section of the light emitting device LED may be determined corresponding to a turn-on section of the fourth and fifth transistors T4 and T5. In addition, the turn-on section of the fourth and fifth transistors T4 and T5 may correspond to a gate-on section of the emission control signal, and a turn-off section of the fourth and fifth transistors T4 and T5 may correspond to a gate-off section of the emission control signal.

Figure 3A:
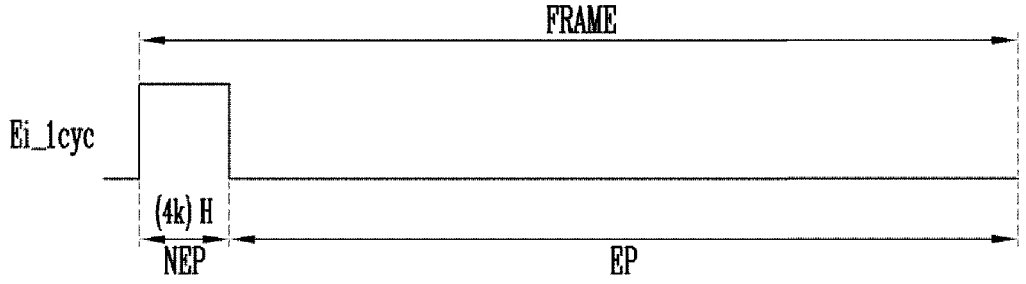
FIGS. 3A and 3B are waveform diagrams illustrating a method for driving the display device shown in FIG. 1 according to exemplary embodiments of the inventive concept.
Figure 3B:
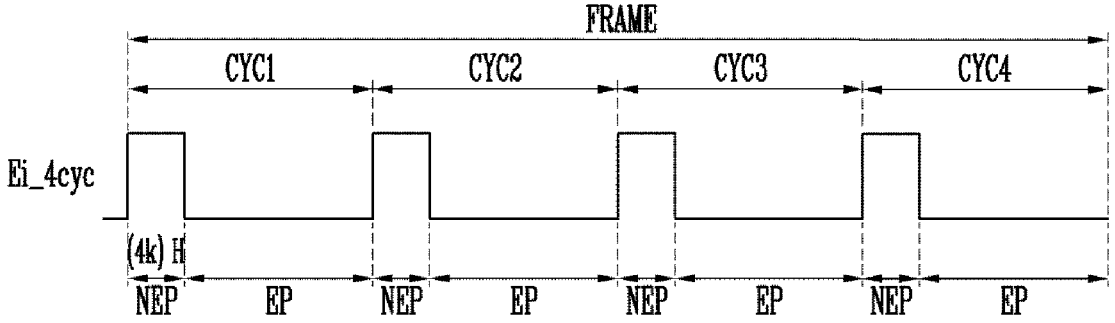

FIGS. 3A and 3B are waveform diagrams illustrating a method for driving the display device shown in FIG. 1 according to exemplary embodiments of the inventive concept.

Referring to FIGS. 3A and 3B, an emission control signal Ei_1cyc or Ei_4cyc corresponding to one frame may define at least one emission section EP and at least one non-emission section NEP.

In an exemplary embodiment of the inventive concept, as shown in FIG. 3A, the emission control signal Ei_1cyc may define one non-emission section NEP corresponding to a high level and one emission section EP corresponding to a low level. The non-emission section NEP may correspond to a gate-off section of the emission control signal Ei_1cyc.

The gate-off section (e.g., the non-emission section NEP) of the emission control signal Ei_1cyc may correspond to a predetermined horizontal period. For example, the width of the gate-off section of the emission control signal Ei_1cyc may be set to about 4 horizontal periods 4H. As described with reference to FIGS. 1 and 2, when the emission control signal Ei_1cyc is supplied to two consecutive pixel rows, the width of the gate-off section of the emission control signal Ei_1cyc may be basically set to 4 horizontal periods such that initialization and data write operations of the two pixel rows are stably performed. 1 horizontal period 1H may be a period in which a scan signal is shifted or a period in which a data signal is applied in a pixel column direction.

In an exemplary embodiment of the inventive concept, when the display device is driven in a dimming mode, the length of the non-emission section NEP is controlled in response to the dimming signal DIM shown in FIG. 1, so that display luminance can be controlled. For example, a dimming method for controlling the length of the non-emission section may be used in a low-luminance range of about 100 nits or less. However, this is merely illustrative, and the dimming method for controlling the length of the non-emission section may be applied to a predetermined arbitrary luminance range.

In exemplary embodiments of the inventive concept, the width of the gate-off section of the emission control signal Ei_1cyc may be controlled in units of 4 horizontal periods (e.g., as denoted by (4k)H). For example, the width of the gate-off section of the emission control signal Ei_1cyc may be sequentially increased to 4 horizontal periods, 8 horizontal periods, and 12 horizontal periods. When the dimming level is increased, the width of the gate-off section of the emission control signal Ei_1cyc is increased, and therefore, the display luminance may be decreased.

In exemplary embodiments of the inventive concept, as shown in FIG. 3B, the emission control signal Ei_4cyc may define a plurality of non-emission sections NEP corresponding to a high level and a plurality of emission sections EP corresponding to a low level in one frame. For example, one non-emission section NEP and one emission section EP, which are consecutive, may define one emission cycle. In one frame, lengths of emission cycles CYC1 to CYC4 may be equal to one another. Although a case where the emission control signal Ei_4cyc has four emission cycles CYC1 to CYC4 is illustrated in FIG. 3B, the waveform of the emission control signal Ei_4cyc is not limited thereto. For example, the emission control signal Ei_4cyc may include two emission cycles or eight emission cycles according to a design of the display device.

Figure 4:
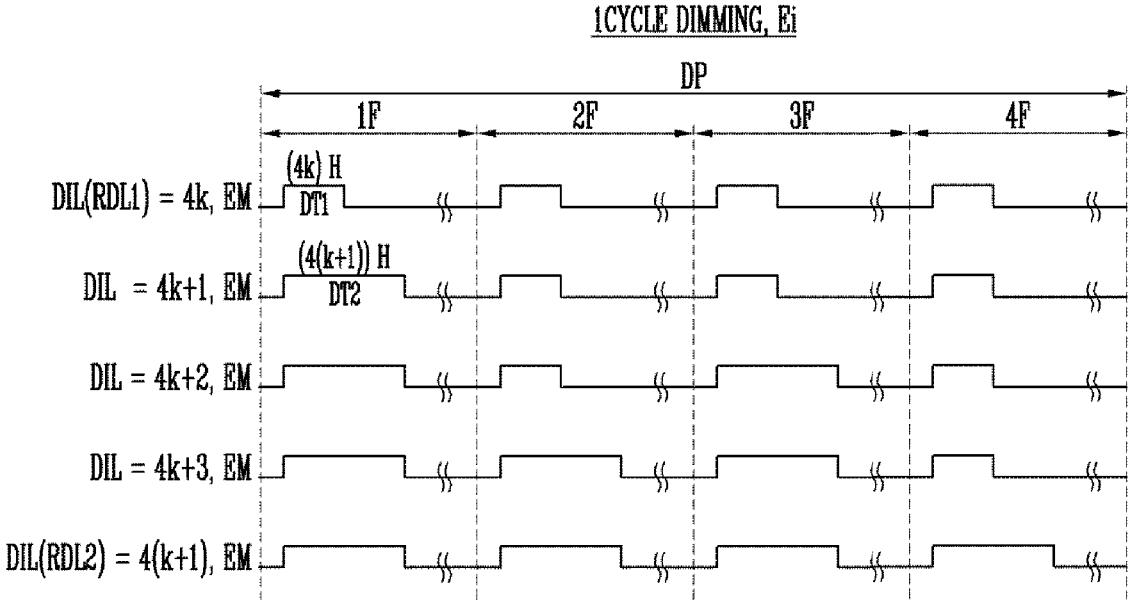
FIG. 4 is a waveform diagram illustrating an output of an emission driver included in the display device shown in FIG. 1 according to an exemplary embodiment of the inventive concept.

FIG. 4 is a waveform diagram illustrating an output of the emission driver included in the display device shown in FIG. 1 according to an exemplary embodiment of the inventive concept.

For convenience of description, an output of an emission control signal EM output to an ith emission control line Ei is illustrated. In addition, a gate-off section (e.g., a non-emission section) of the emission control signal EM is a high level section of the emission control signal EM.

Referring to FIGS. 1 to 4, the emission driver 300 may output the emission control signal EM having one emission cycle.

In an exemplary embodiment of the inventive concept, when one frame includes one emission cycle, a dimming period DP may correspond to four frames. In other words, first to fourth frames 1F to 4F may be included in the dimming period DP. The dimming period DP may be determined in one frame period with respect to the corresponding emission cycle. The dimming period DP is determined by an arrangement rule of gate-off sections output according to a lapse of frames.

For example, when one frame includes one emission cycle, the emission control signal EM having all dimming levels DIL may commonly have a width of the same gate-off section for every fourth frame.

The width of the gate-off section of the emission control signal EM may be controlled in units of 4 horizontal periods. The dimming level DIL may be the width of a gate-off section of the emission control signal EM to be output (or the length of a horizontal period corresponding to the gate-off section).

When the dimming level DIL is 4k (where k is a natural number), the width of the gate-off section of the emission control signal EM may be determined as 4k horizontal periods (denoted by (4k)H in FIG. 4). Therefore, as shown in FIG. 4, the emission control signal EM having a gate-off section of 4k horizontal periods may be output for every frame. The display device 1000 may emit light with a luminance corresponding to the gate-off section of 4k horizontal periods. For example, the emission driver 300 may output the emission control signal EM having a gate-off section of 4 horizontal periods in response to a dimming level of 4 horizontal periods.

Similarly, when the dimming level DIL is 4(k+1), the width of the gate-off section of the emission control signal EM may be determined as 4(k+1) horizontal periods (denoted by (4(k+1))H in FIG. 4). Therefore, the width of the gate-off section may be increased by 4 horizontal periods for every fourth dimming level DIL.

Hereinafter, for convenience of description, the gate-off section of 4k horizontal periods is described as a first off section DT1, and the gate-off section of 4(k+1) horizontal periods is described as a second off section DT2.

In addition, the dimming level DIL indicating an output of the gate-off section of 4k horizontal periods may be set as a first reference dimming level RDL1, and the dimming level DIL indicating an output of the gate-off section of 4(k+1) horizontal periods may be set as a second reference dimming level RDL2. In other words, the first and second reference dimming levels RDL1 and RDL2 may be dimming levels DIL indicating outputs of the gate-off section of 4k horizontal periods and the gate-off section of 4(k+1) horizontal periods, respectively.

In an exemplary embodiment of the inventive concept, a first width (e.g., DIL=4k) of the gate-off section, which is indicated by the first reference dimming level RDL1, may be equal to that of the first off section DT1, and a second width (e.g., DIL=4(k+1)) of the gate-off section indicated by the second reference dimming level RDL2 may be equal to that of the second off section DT2. In other words, the length (or width) of the second off section DT2 may be greater than that of the first off section DT1.

As described above, the width of the gate-off section of the emission control signal EM is changed for every fourth horizontal period. Therefore, gate-off sections of 5 horizontal periods 5H, 6 horizontal periods 6H, and the like are not output.

The display device 1000 according to an exemplary embodiment of the inventive concept controls outputs of gate-off sections of the emission control signal EM such that an average of the gate-off sections of the emission control signal EM per frame corresponds to a horizontal period required by the dimming level DIL in the dimming period DP. For example, the emission control signal EM corresponding to each of dimming levels (e.g., DIL=4k+1, DIL=4k+2, and DIL=4k+3 in FIG. 4) between the first reference dimming level RDL1 and the second reference dimming level RDL2 may include a combination of first and second off sections DT1 and DT2 in the dimming period DP.

In response to the dimming level DIL corresponding to 4k+1 horizontal periods, the emission control signal EM may have one second off section DT2 and three first off sections DT1 during the dimming period DP. For example, in response to the dimming level DIL of 5 horizontal periods, the emission control signal EM may have widths of gate-off sections in a sequence of 8-4-4-4 horizontal periods during the dimming period DP. An average width of gate-off sections per frame may correspond to 5 horizontal periods (e.g., (8+4+4+4)/4=5). Therefore, from a combination of a first off section DT1 of 4 horizontal periods and a second off section DT2 of 8 horizontal periods, an image with a luminance corresponding to the gate-off section of 5 horizontal periods on average may be displayed during the dimming period DP.

Similarly, in response to the dimming level DIL corresponding to 4k+2 horizontal periods, the emission control signal EM may have two second off sections DT2 and two first off sections DT1 during the dimming period DP. For example, in response to the dimming level DIL of 6 horizontal periods, the emission control signal EM may have widths of gate-off sections in a sequence of 8-4-8-4 horizontal periods during the dimming period DP. An average width of gate-off sections per frame may correspond to 6 horizontal periods (e.g., (8+4+8+4)/4=6). Therefore, an image with a luminance corresponding to the gate-off section of 6 horizontal periods on average may be displayed.

In response to the dimming level DIL corresponding to 4k+3 horizontal periods, the emission control signal EM may have three second off sections DT2 and one first off section DT1 during the dimming period DP. For example, in response to the dimming level DIL of 7 horizontal periods, the emission control signal EM may have widths of gate-off sections in a sequence of 8-8-8-4 horizontal periods during the dimming period DP. An average width of gate-off sections per frame may correspond to 7 horizontal periods (e.g., (8+8+8+4)/4=7). Therefore, an image with a luminance corresponding to the gate-off section of 7 horizontal periods on average may be displayed.

An average width of all gate-off sections included in the dimming period DP per frame may be substantially equal to the width of the gate-off section, which is indicated by the dimming level DIL. Meanwhile, as shown in FIG. 4, arrangements of the first and second off sections DT1 and DT2 according to a lapse of frames in the dimming period DP may be differently set with respect to dimming levels. In an exemplary embodiment of the inventive concept, in the range of dimming levels between the first reference dimming level RDL1 and the second reference dimming level RDL2, the number of first off sections DT1 may decrease and the number of second off sections DT2 may increase as the dimming level DIL increases. Accordingly, display luminance can be smoothly decreased when the dimming level DIL increases.

Meanwhile, the sum of a number of first off sections DT1 included in the dimming period DP and a number of second off sections DT2 included in the dimming period DP may be constant regardless of the dimming level DIL. In other words, when the dimming period DP of the emission control signal EM including one emission cycle corresponds to 4 frames, the sum of a number of first off sections DT1 included in the dimming period DP and a number of second off sections DT2 included in the dimming period DP may be 4.

As described above, the display device 1000 according to an exemplary embodiment of the inventive concept controls and outputs the width of the gate-off section of the emission control signal EM in the dimming period DP according to dimming levels DIL, so that the resolution of display luminance using a dimming method for controlling the length of a non-emission section can be improved. Thus, smoother and more precise luminance dimming can be implemented.

Figure 5A:
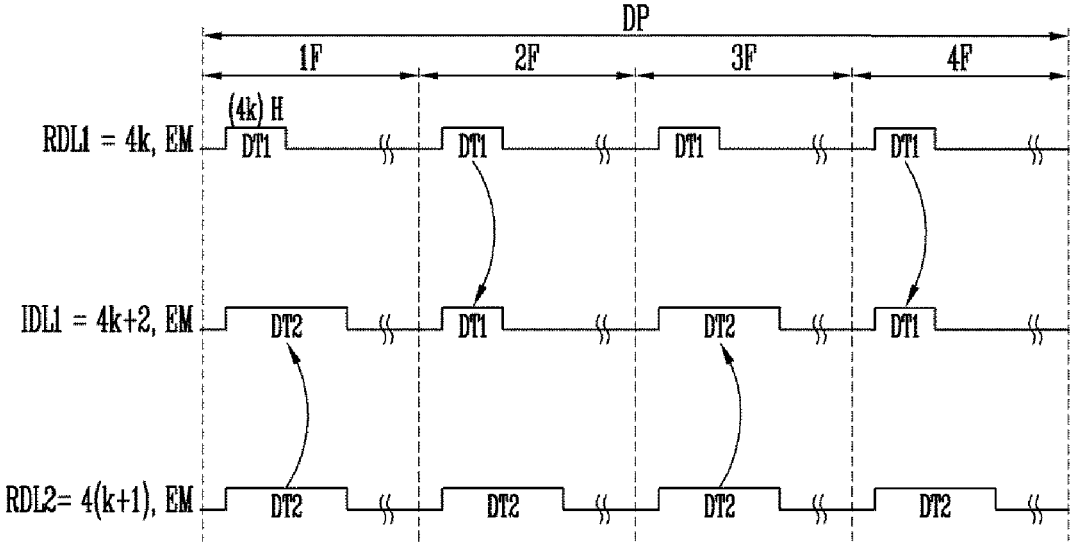
FIGS. 5A to 5C are diagrams illustrating a method for determining the output of the emission driver of FIG. 4 according to an exemplary embodiment of the inventive concept.
Figure 5B:
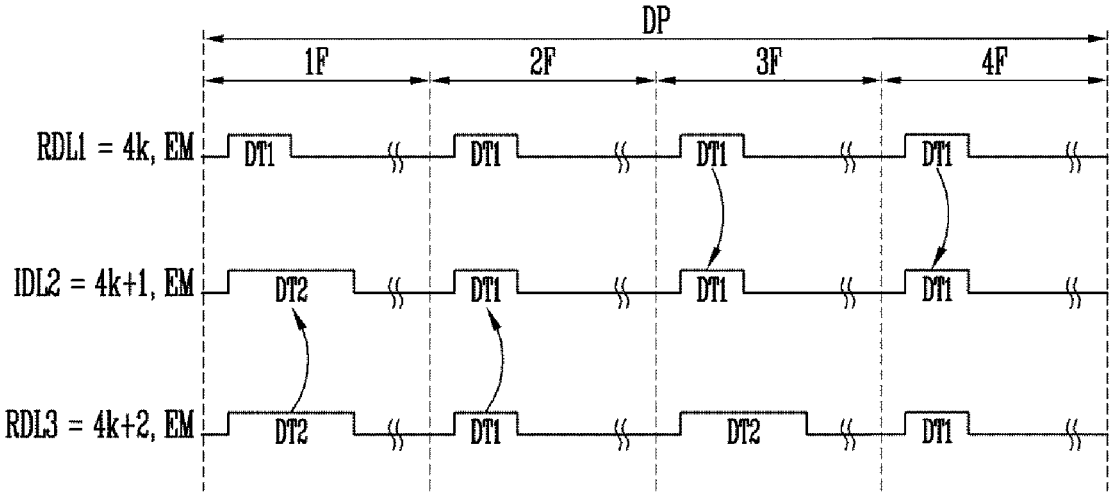
Figure 5C:
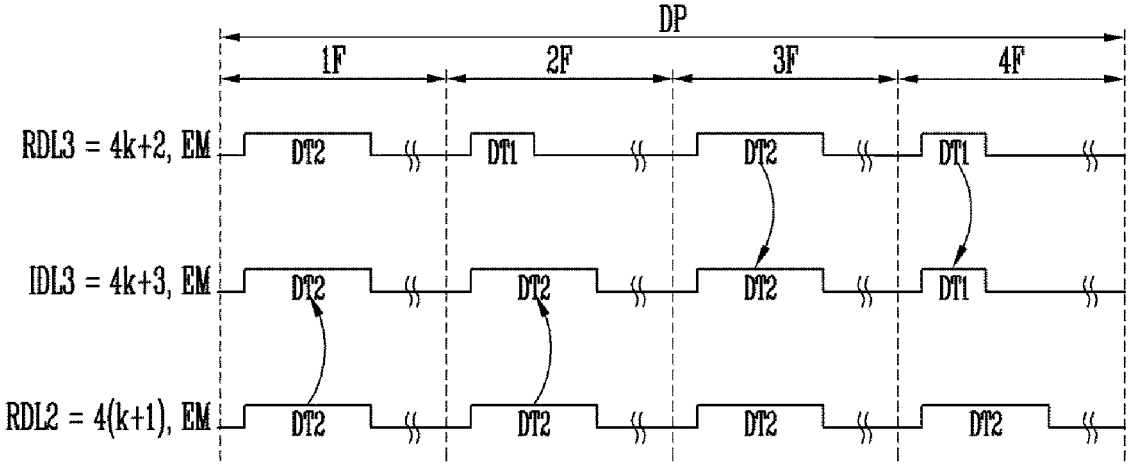

FIGS. 5A to 5C are diagrams illustrating a method for determining the output of the emission driver of FIG. 4 according to an exemplary embodiment of the inventive concept. FIG. 6 is a conceptual diagram illustrating the output of the emission driver of FIG. 4 according to an exemplary embodiment of the inventive concept.

Referring to FIGS. 4 to 6, the emission control signal EM corresponding to each dimming level DIL may be output from a combination of first and second off sections DT1 and DT2 output during the dimming period DP.

First, a dimming level corresponding to 4k horizontal periods may be referred to as the first reference dimming level RDL1, and a dimming level corresponding to 4(k+1) horizontal periods may be referred to as the second reference dimming level RDL2. The first off section DT1 (corresponding to 4k horizontal periods) may be determined from the first reference dimming level RDL1, and the second off section DT2 (corresponding to 4(k+1) horizontal periods) may be determined from the second reference dimming level RDL2.

As shown in FIG. 5A, a first intermediate dimming level IDL1 (corresponding to 4k+2 horizontal periods) that is an intermediate value between the first reference dimming level RDL1 and the second reference dimming level RDL2 is selected. In addition, a combination of the first and second off sections DT1 and DT2 included in the dimming period DP may be determined corresponding to the first intermediate dimming level IDL1. In an exemplary embodiment of the inventive concept, the width of an output gate-off section of the first intermediate dimming level IDL1, which corresponds to odd-numbered frames (e.g., first and third frames 1F and 3F), may be selected from the second reference dimming level RDL2, and the width of an output gate-off section of the first intermediate dimming level IDL1, which corresponds to even-numbered frames (e.g., second and fourth frames 2F and 4F), may be selected from the first reference dimming level RDL1.

In other words, the width of an output gate-off section corresponding to the first intermediate dimming level IDL1 may be provided in a form in which the second off section DT2 and the first off section DT1 are alternately output. Therefore, an average length of non-emission sections per frame may correspond to 4k+2 horizontal periods in the dimming period DP of the emission control signal EM corresponding to the first intermediate dimming level IDL1.

However, this is merely illustrative, the output sequence of first and second off sections DT1 and DT2 corresponding to the first intermediate dimming level IDL1 is not limited thereto. For example, an emission control signal having the second off section DT2 may be output in the first and second frames 1F and 2F, and an emission control signal having the first off section DT1 may be output in the third and fourth frames 3F and 4F.

Meanwhile, as shown in FIG. 5B, the first intermediate dimming level IDL1 may be used or set as a new reference dimming level. For example, the first intermediate dimming level IDL1 may be determined as a third reference dimming level RDL3, and a width of an output gate-off section corresponding to a second intermediate dimming level IDL2 (e.g., a dimming level corresponding to 4k+1 horizontal periods) that is an intermediate value between the first reference dimming level RDL1 and the third reference dimming level RDL3 may be determined.

Output gate-off sections corresponding to the second intermediate dimming level IDL2 may be determined from a combination of output gate-off sections corresponding to the first reference dimming level RDL1 and output gate-off sections corresponding to the third reference dimming level RDL3. For example, output gate-off sections of the first and second frames 1F and 2F may be selected from the third reference dimming level RDL3, and output gate-off sections of the third and fourth frames 3F and 4F may be selected from the first reference dimming level RDL1. In other words, the arrangement of first and second off sections DT1 and DT2 may be recombined to correspond to the second intermediate dimming level IDL2.

An average length of non-emission sections corresponding to the second intermediate dimming level IDL2 per frame may correspond to 4k+1 horizontal periods. For example, three first off sections DT1 and one second off section DT2 may be included in the dimming period DP.

As shown in FIG. 5C, gate-off sections of a third intermediate dimming level IDL3 (e.g., a dimming level corresponding to 4k+3 horizontal periods) that is an intermediate value between the third reference dimming level RDL3 and the second reference dimming level RDL2 may be determined. The gate-off sections of the third intermediate dimming level IDL3 may be determined using a method substantially identical to that for determining gate-off sections of the second intermediate dimming level IDL2.

For example, widths of gate-off sections of the first and second frames 1F and 2F may be selected from the second reference dimming level RDL2, and widths of gate-off sections of the third and fourth frames 3F and 4F may be selected from the third reference dimming level RDL3. In other words, the arrangement of first and second off sections DT1 and DT2 may be recombined to correspond to the third intermediate dimming level IDL3.

An average length of non-emission sections corresponding to the third intermediate dimming level IDL3 per frame may correspond to 4k+3 horizontal periods. For example, three second off sections DT2 and one first off section DT1 may be included in the dimming period DP.

FIG. 6 illustrates a gate-off section (non-emission section) of the emission control signal EM in the dimming period DP. The first off section DT1 may correspond to 4 horizontal periods 4H, and the second off section DT2 may correspond to 8 horizontal periods 8H. Arrangements of the first and second off sections DT1 and DT2 according to a lapse of frames in the dimming period DP may be differently set with respect to the dimming levels DIL. In an exemplary embodiment of the inventive concept, when the dimming level DIL increases, the number of first off sections DT1 (e.g., 4H) may decrease, and the number of second off section DT2 (e.g., 8H) may increase. Accordingly, display luminance can be smoothly decreased when the dimming level DIL increases. In a range of the dimming level DIL between the first reference dimming level RDL1 and the second reference dimming level RDL2, the number of the first off sections DT1 of the emission control signal EM decreases and the number of the second off sections DT2 of the emission control signal EM increases, when the dimming level DIL increases.

Figure 7:
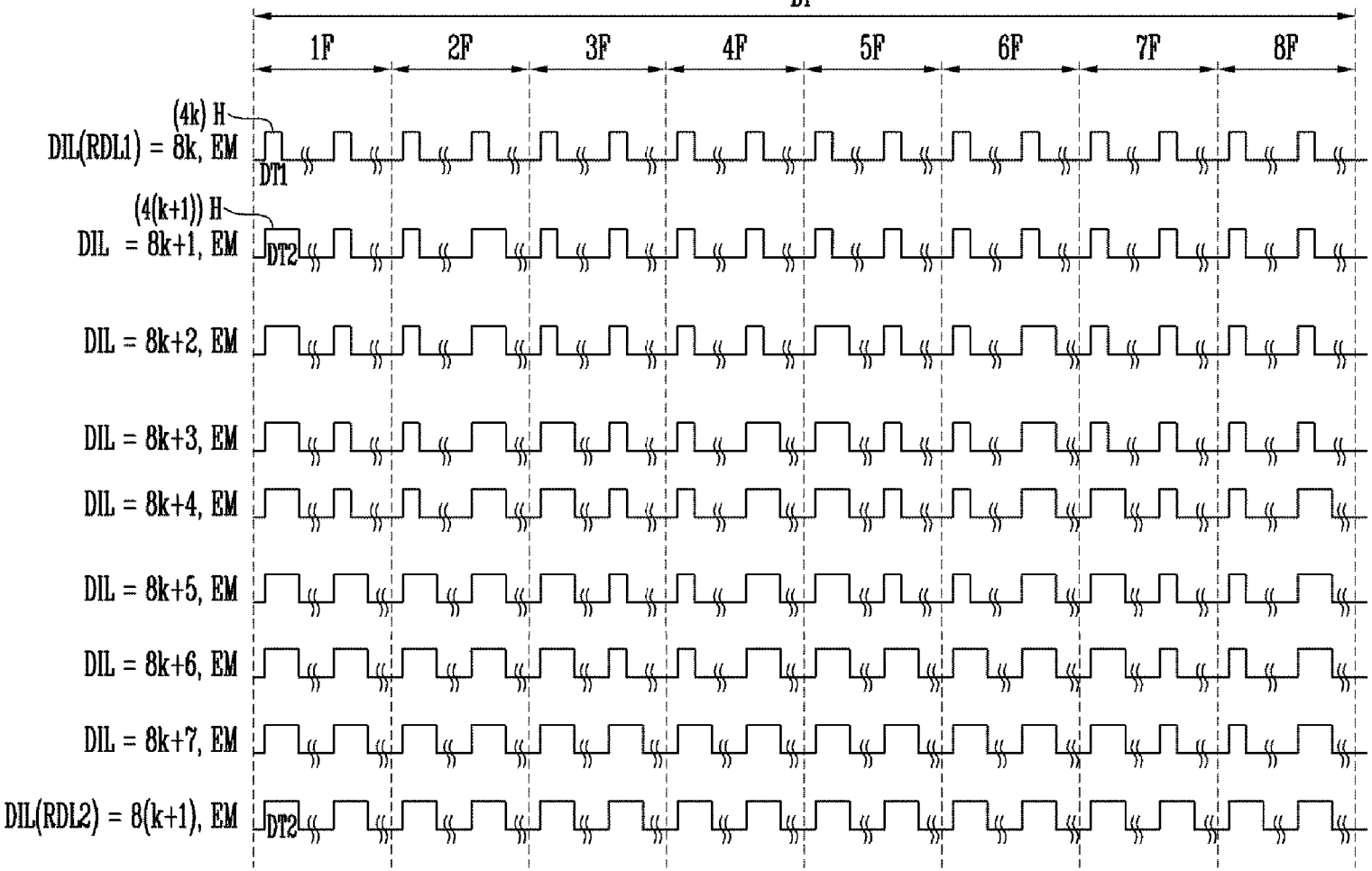
FIG. 7 is a waveform diagram illustrating an output of the emission driver included in the display device shown in FIG. 1 according to an exemplary embodiment of the inventive concept.

FIG. 7 is a waveform diagram illustrating an output of the emission driver included in the display device shown in FIG. 1 according to an exemplary embodiment of the inventive concept.

In FIG. 7, components identical to those described with reference to FIG. 4 are designated by like reference numerals, and their overlapping descriptions will be omitted. In addition, an output of the emission driver, which is shown in FIG. 7, may have a configuration identical or similar to that of the output of the emission driver, which is shown in FIG. 4, except an emission cycle included in a frame.

Referring to FIGS. 1 and 7, the emission driver 300 may output the emission control signal EM including a plurality of emission cycles.

The emission driver 300 may output the emission control signal EM including i (where i is an integer greater than 1) gate-off sections corresponding to i non-emission sections in one frame. As shown in FIG. 7, the emission control signal EM may be driven in two cycles including two non-emission sections (e.g., two gate-off sections) in one frame. The one frame may include a first cycle and a second cycle.

When the one frame has i gate-off sections, the dimming period DP may correspond to (4*i) frames. In an exemplary embodiment of the inventive concept, when two gate-off sections (non-emission sections) are output in the one frame, the dimming period DP may correspond to 8 frames.

The width of a gate-off section of the emission control signal EM may be controlled for every fourth horizontal period. The dimming level DIL may be the width of the gate-off section of the emission control signal EM to be output (or the length of a horizontal period corresponding to the width of the gate-off section).

A dimming level indicating an output of a gate-off section of 8k horizontal periods may be set as the first reference dimming level RDL1, and the dimming level DIL indicating an output of a gate-off section of 8(k+1) horizontal periods may be set as the second dimming level RDL2. A width (e.g., DIL=8k) of the gate-off section, which is indicated by the first reference dimming level RDL1, may be equal to that of the first off section DT1, and a width (e.g., DIL=8(k+1)) of the gate-off section, which is indicated by the second reference dimming level RDL2, may be equal to that of the second off section DT2.

The emission control signal EM corresponding to each of dimming levels (e.g., DIL=8k+1, . . . , and DIL=8k+7 in FIG. 7) between the first reference dimming level RDL1 and the second reference dimming level RDL2 may include a combination of the first and second off sections DT1 and DT2 in the dimming period DP.

In response to the dimming level DIL corresponding to 8k+1 horizontal periods, the emission control signal EM may have two second off sections DT2 and 14 first off sections DT1 during the dimming period DP. For example, an average length of gate-off sections of the emission control signal EM output in response to the dimming level DIL of 9 horizontal periods per frame may correspond to 9 horizontal periods 9H (e.g., (4*14+8*2)/8=9). Therefore, from a combination of the first off section DT1 of 4 horizontal periods and the second off section DT2 of 8 horizontal periods, an image with a luminance corresponding to the non-emission section of 9 horizontal periods on average may be displayed during the dimming period DP.

Similarly, gate-off sections of the emission control signal EM having dimming levels respectively corresponding to 8k+2 horizontal periods to 8k+7 horizontal periods may be determined.

Arrangements of the first and second off sections DT1 and DT2 according to a lapse of frames in the dimming period DP may be differently set with respect to the dimming levels DIL. In an exemplary embodiment of the inventive concept, in a range between the first reference dimming level RDL1 and the second reference dimming level RDL2, the number of the first off sections DT1 may decrease and the number of the second off sections DT2 may increase, when the dimming level DIL increases. Accordingly, display luminance can be smoothly decreased when the dimming level DIL increases.

Meanwhile, the sum of a number of the first off sections DT1 included in the dimming period DP and a number of the second off sections DT2 included in the dimming period DP may be constant regardless of the dimming level DIL. In other words, when the dimming period DP of the emission control signal EM including one emission cycle corresponds to 8 frames, the sum of a number of the first off sections DT1 included in the dimming period DP and a number of the second off sections DT2 included in the dimming period DP may be 16.

However, this is merely illustrative, and the emission cycle is not limited thereto. For example, when 4 non-emission sections are included in one frame (4 drive cycles), the dimming period DP may correspond to 16 frames, and an output of an emission control signal for each dimming level DIL may be changed using 16 frames as a period.

Figure 8A:
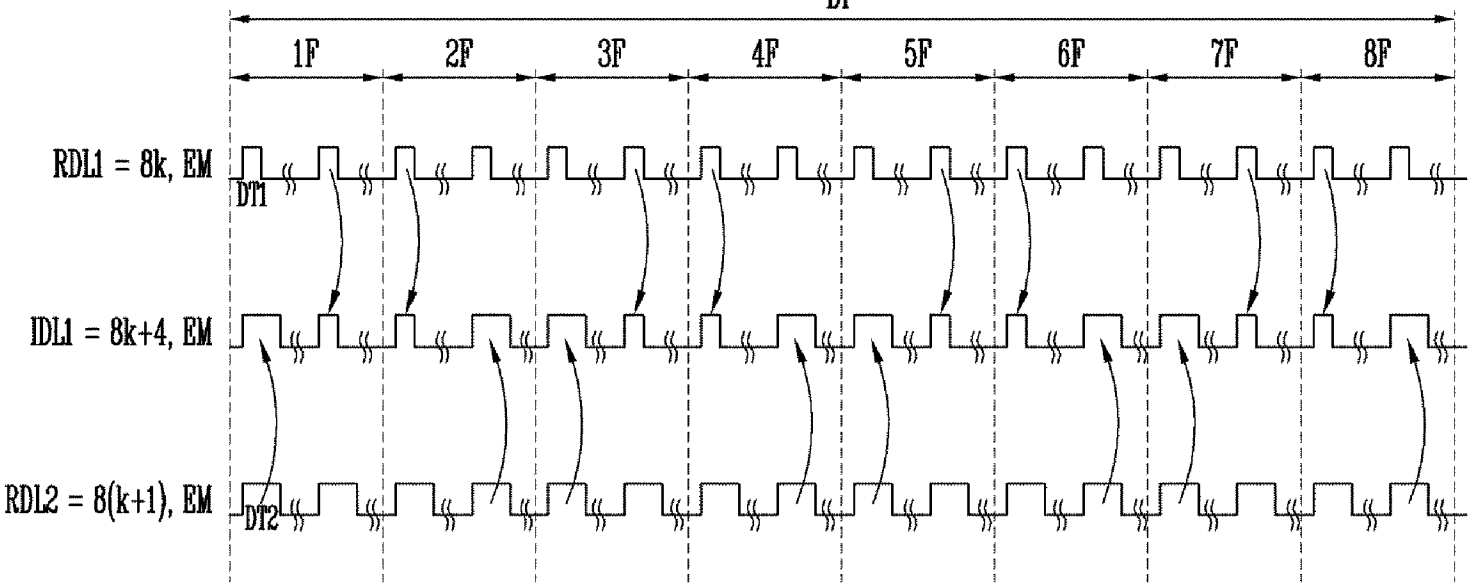
FIGS. 8A to 8C are diagrams illustrating a method for determining the output of the emission driver of FIG. 7 according to an exemplary embodiment of the inventive concept.
Figure 8B:
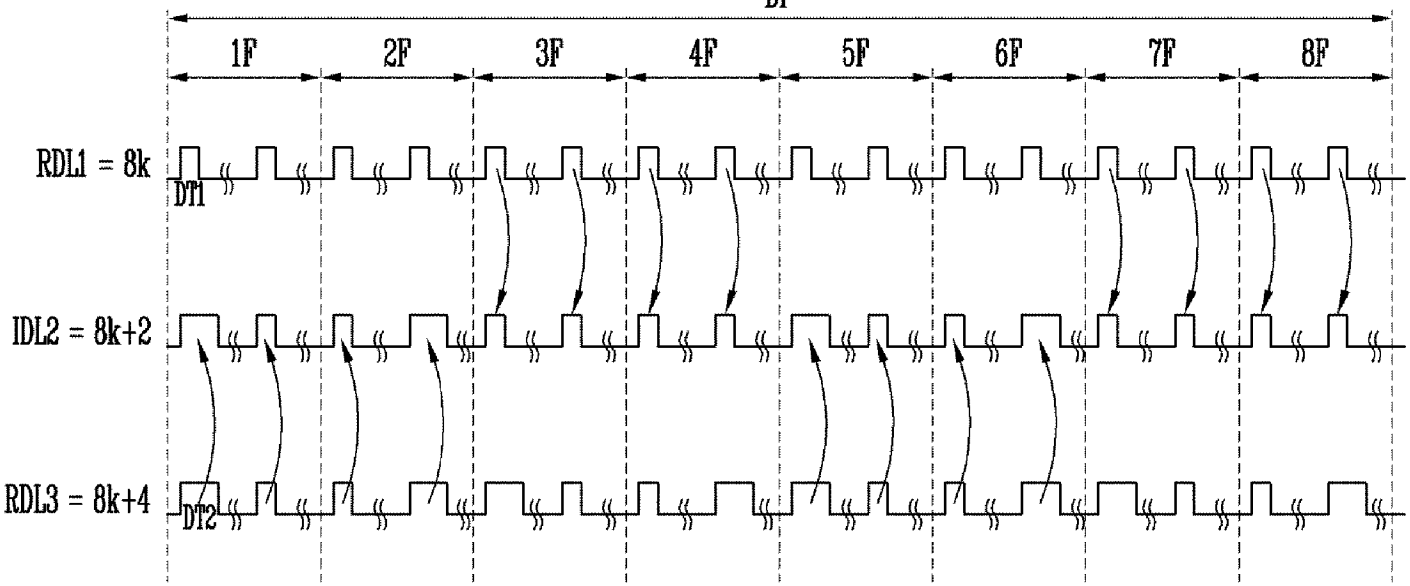
Figure 8C:
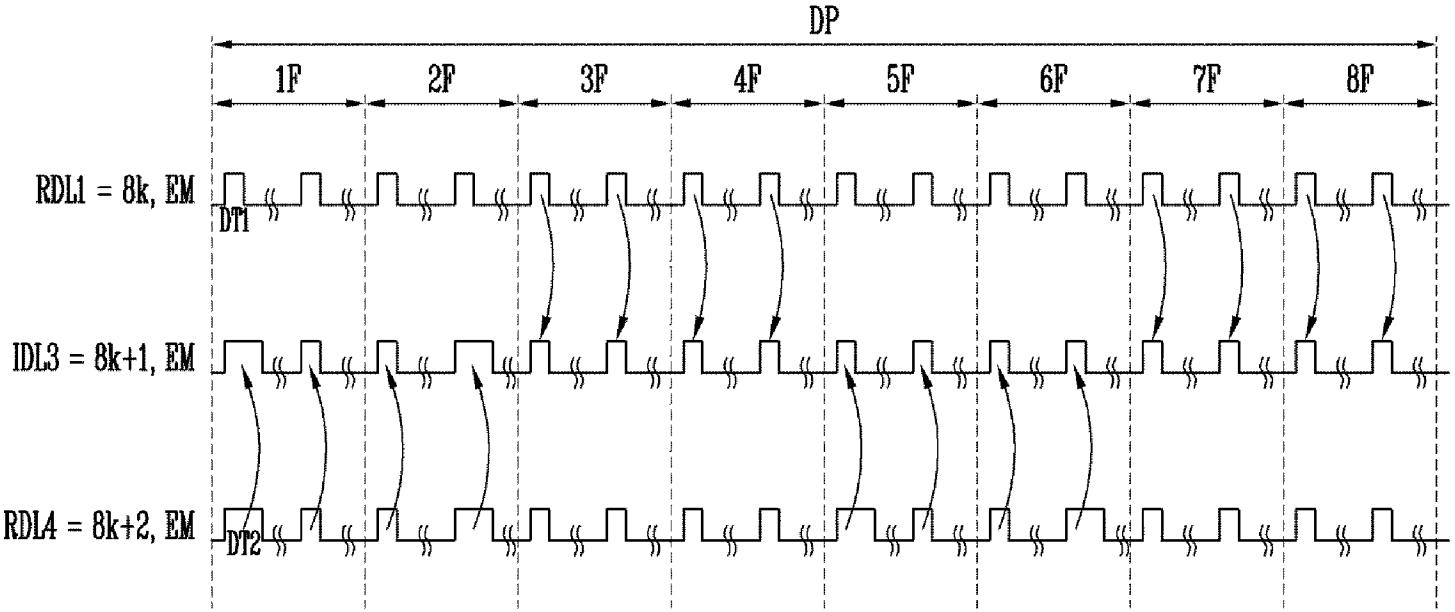

FIGS. 8A to 8C are diagrams illustrating a method for determining the output of the emission driver of FIG. 7 according to an exemplary embodiment of the inventive concept.

In FIGS. 8A to 8C, components identical to those described with reference to FIGS. 5A to 5C are designated by like reference numerals, and their overlapping descriptions will be omitted.

Referring to FIGS. 7 to 8C, the emission control signal EM corresponding to each dimming level DIL may be output from a combination of the first and second off sections DT1 and DT2 output during the dimming period DP.

Combinations of off sections of the first cycle and the second cycle in a frame are independently determined. A dimming level corresponding to 8k horizontal periods may be referred to as the first reference dimming level RDL1, and a dimming level corresponding to 8(k+1) horizontal periods may be referred to as the second reference dimming level RDL2. The first off section DT1 (corresponding to 8k horizontal periods) may be determined from the first reference dimming level RDL1, and the second off section DT2 (corresponding to 8(k+1) horizontal periods) may be determined from the second reference dimming level RDL2.

As shown in FIG. 8A, a first intermediate dimming level IDL1 (corresponding to 8k+4 horizontal periods) that is an intermediate value between the first reference dimming level RDL1 and the second reference dimming level RDL2 is selected. In addition, a combination of the first and second off sections DT1 and DT2 included in the dimming period DP may be determined corresponding to the first intermediate dimming level IDL1.

In an exemplary embodiment of the inventive concept, the width of a gate-off section of the first intermediate dimming level IDL1, which corresponds to a first cycle of odd-numbered frames (e.g., 1F, 3F, 5F, and 7F), may be selected from the second reference dimming level RDL2, and the width of a gate-off section of the first intermediate dimming level IDL1, which corresponds to a second cycle of the odd-numbered frames, may be selected from the first reference dimming level RDL1. In addition, the width of a gate-off section of the first intermediate dimming level IDL1, which corresponds to a first cycle of even-numbered frames (e.g., 2F, 4F, 6F, and 8F), may be selected from the first reference dimming level RDL1, and the width of a gate-off section of the first intermediate dimming level IDL1, which corresponds to a second cycle of the even-numbered frames, may be selected from the second reference dimming level RDL2.

A number of the first off sections DT1 corresponding to the first intermediate dimming level IDL1 and a number of the second off sections DT2 corresponding to the first intermediate dimming level IDL1 may be equal to each other. Therefore, the emission control signal EM corresponding to the first intermediate dimming level IDL1 may have an average length of non-emission sections of 4k+2 horizontal periods per frame.

As shown in FIG. 8B, the first intermediate dimming level IDL1 may be used as a new reference dimming level. For example, the first intermediate dimming level IDL1 may be determined as a third reference dimming level RDL3, and widths of gate-off sections corresponding to a second intermediate dimming level IDL2 (e.g., a dimming level corresponding to 8k+2 horizontal periods) that is an intermediate value between the first reference dimming level RDL1 and the third reference dimming level RDL3 may be determined.

Widths of gate-off sections corresponding to the second intermediate dimming level IDL2 may be determined from a combination of widths of gate-off sections corresponding to the first reference dimming level RDL1 and widths of gate-off sections corresponding to the third reference dimming level RDL3. For example, widths of gate-off sections of first and second frames 1F and 2F may be selected from the third reference dimming level RDL3, and widths of gate-off sections of third and fourth frames 3F and 4F may be selected from the first reference dimming level RDL1. In other words, the arrangement of first and second off sections DT1 and DT2 may be recombined to correspond to the second intermediate dimming level IDL2.

An average length of non-emission sections corresponding to the second intermediate dimming level IDL2 per frame may correspond to 8k+2 horizontal periods. For example, fourteen first off sections DT1 and two second off section DT2 may be included in the dimming period DP.

As shown in FIG. 8C, the second intermediate dimming level IDL2 may be used as a new reference dimming level. For example, the second intermediate dimming level IDL2 may be determined as a fourth reference dimming level RDL4. Widths of gate-off sections of a third intermediate dimming level IDL3 may be determined using a method substantially identical to that for determining widths of gate-off sections of the second intermediate dimming level IDL2.

With respect to the other dimming levels, widths of gate-off sections may be determined using a method substantially identical or similar to that shown in FIGS. 8B and 8C. Accordingly, different outputs of the emission control signal EM may be determined according to the dimming levels DIL shown in FIG. 7. Thus, in the display device configured to substantially simultaneously supply the emission control signal EM in units of a plurality of pixel rows, the resolution of display luminance using a dimming method for controlling the length of a non-emission section can be improved. Further, smoothness in luminance dimming may be improved.

Figure 9:
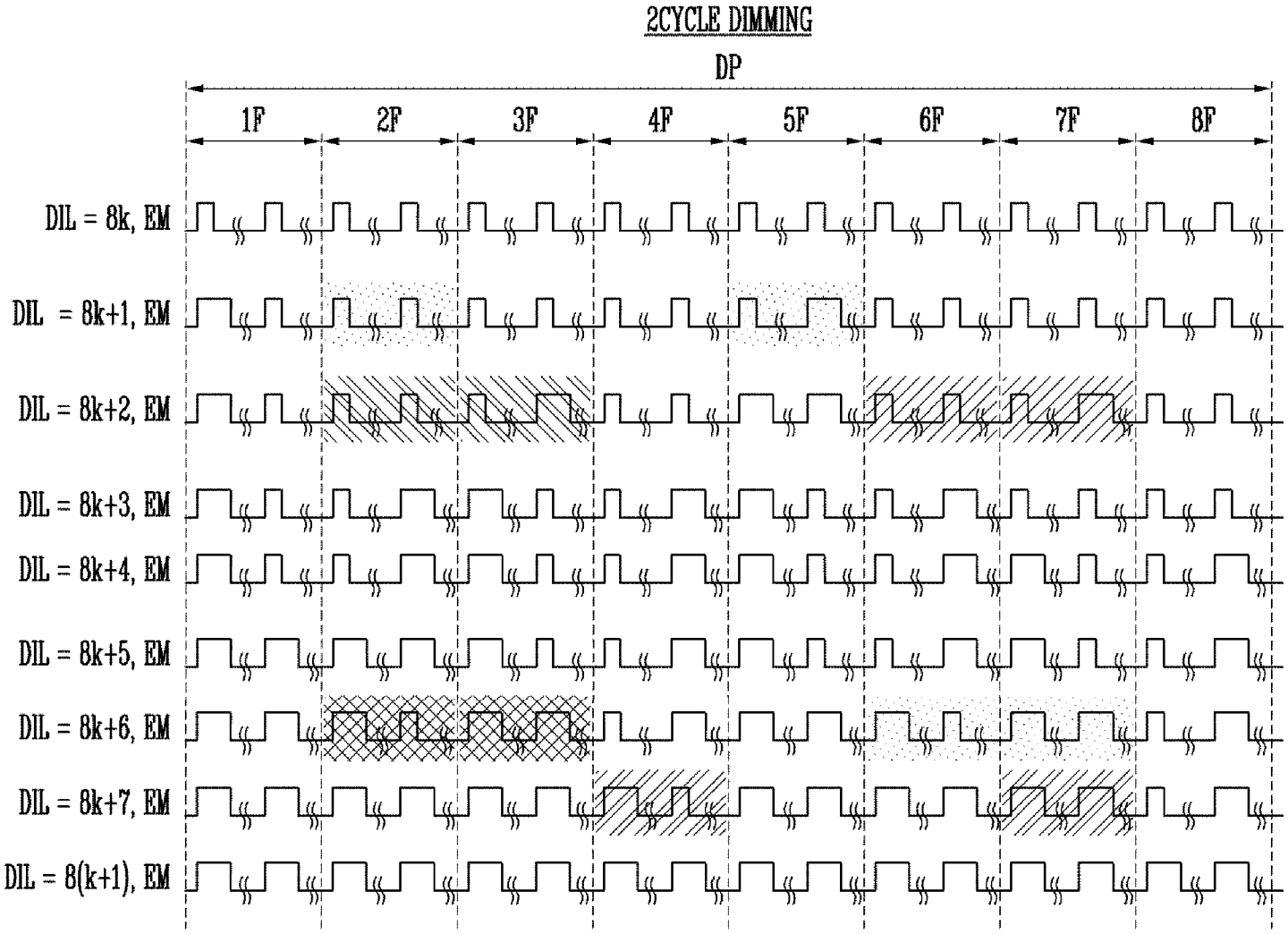
FIG. 9 is a waveform diagram illustrating the output of the emission driver included in the display device shown in FIG. 1 according to an exemplary embodiment of the inventive concept.

FIG. 9 is a waveform diagram illustrating the output of the emission driver included in the display device shown in FIG. 1 according to an exemplary embodiment of the inventive concept.

In FIG. 9, components identical to those described with reference to FIG. 7 are designated by like reference numerals, and their overlapping descriptions will be omitted. In addition, an output of the emission driver, which is shown in FIG. 9, may have a configuration identical or similar to that of the output of the emission driver, which is shown in FIG. 7, except output waveforms of some frames.

Referring to FIGS. 7 and 9, the emission driver 300 may output the emission control signal EM including a plurality of emission cycles.

In exemplary embodiments of the inventive concept, the emission control signal EM may be driven in two cycles including two non-emission sections (e.g., two gate-off sections) in one frame. When an image is displayed, a case where the dimming period DP is not completely expressed may occur. For example, when one image is displayed during only four frames or five frames by the driving method shown in FIG. 7, an output of the emission control signal EM, which corresponds to the dimming level DIL of 8k+1 horizontal periods, and an output of the emission control signal EM, which corresponds to the dimming level of 8k+2 horizontal periods, may be identical to each other. Therefore, dimming according to the dimming level DIL may not be appropriately implemented.

To further improve luminance resolution, in an exemplary embodiment of the inventive concept, outputs of gate-off sections of some frames of the emission control signal EM shown in FIG. 7 may be exchanged with one another in the dimming period DP. For example, in the emission control signal EM corresponding to the dimming level DIL of 8k+1 horizontal periods, an output of the second frame 2F and an output of a fifth frame 5F may be exchanged with each other. In addition, in the emission control signal EM corresponding to the dimming level DIL of 8k+2 horizontal period, outputs of the second frame 2F and the third frame 3F may be exchanged with each other, and outputs of a sixth frame 6F and a seventh frame 7F may be exchanged with each other. In the emission control signal EM corresponding to the dimming level DIL of 8k+6 horizontal periods, outputs of the second frame 2F and the third frame 3F may be exchanged with each other, and outputs of the sixth frame 6F and the seventh frame 7F may be exchanged with each other. Similarly, in the emission control signal EM corresponding to the dimming level DIL of 8k+7 horizontal periods, outputs of the fourth frame 4F and the seventh frame 7F may be exchanged with each other.

Accordingly, a change in output of gate-off sections according to adjacent dimming levels DIL is further segmented, so that the resolution of display luminance in dimming of the display device can be further improved.

However, this is merely illustrative, and outputs of the emission control signal EM between other frame sections may be exchanged with each other.

Figure 10:
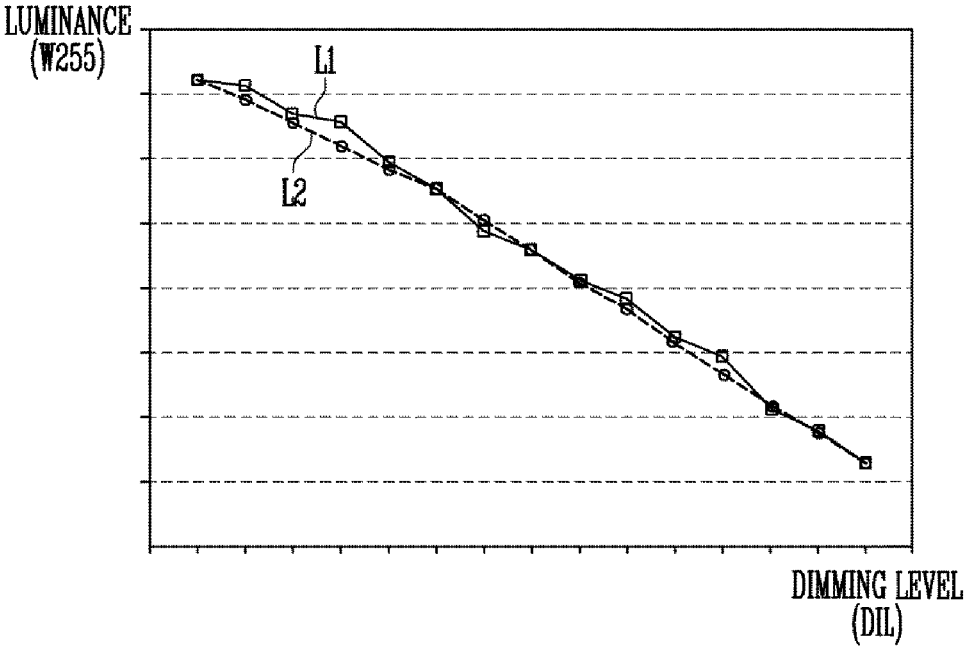
FIG. 10 is a conceptual diagram illustrating dimming with respect to a dimming level according to an exemplary embodiment of the inventive concept.

FIG. 10 is a conceptual diagram illustrating dimming with respect to a dimming level according to an exemplary embodiment of the inventive concept.

Referring to FIG. 10, display luminance may be changed depending on a change in gate-off section of the emission control signal EM, which corresponds to the dimming level DIL.

A first curve L1 represents display dimming of white 255 grayscale, using a conventional dimming method, and a second curve L2 represents display dimming of white 255 grayscale, using the dimming method according to an exemplary embodiment of the inventive concept.

In the conventional dimming method in which an emission control signal is supplied for every fourth horizontal period, display luminance is changed at an interval of predetermined dimming levels DIL. Therefore, dimming is not natural in dimming of the display device.

However, in the display device and method for driving the same according to an exemplary embodiment of the inventive concept, widths of gate-off sections of an emission control signal in a dimming period are differently changed with respect to the dimming levels DIL, so that the resolution of display of luminance in dimming of the display device can be improved. Thus, smooth dimming can be observed when dimming the display device, and the luminance quality of the display device can be improved.

While the inventive concept has been shown and described with reference to exemplary embodiments thereof, it will be understood by those of ordinary skill in the art that various changes in form and details may be made thereto without departing from the spirit and scope of the inventive concept as set forth in the following claims.

What is claimed is:

1. A display device comprising:

a display unit including a plurality of pixel rows connected to at least one data line, a plurality of scan lines and a plurality of emission control lines;

a controller configured to determine a width of a gate-off section of an emission control signal in response to a dimming signal, wherein the gate-off section of the emission control signal corresponds to a non-emission section of any one of a plurality of frames; and an emission driver configured to supply the emission control signal to the plurality of pixel rows through the plurality of emission control lines, wherein the dimming signal includes information on a dimming level corresponding to display luminance of the display unit, wherein the controller determines the width of the gate-off section of the emission control signal corresponding to a first reference dimming level as a first width, and determines the width of the gate-off section of the emission control signal corresponding to a second reference dimming level as a second width, the first reference dimming level being higher than the second reference dimming level, wherein in response to the dimming signal in which the information on the dimming level is a first intermediate dimming level, the controller determines the width of the gate-off section of the emission control signal supplied to at least one among the plurality of frames as the first width, and the width of the gate-off section of the emission control signal supplied to a rest of the plurality of frames as the second width, wherein the first intermediate dimming level is a value between the first reference dimming level and the second reference dimming level, and wherein an average of the widths of all gate-off sections of the emission control signal per frame in the plurality of frames corresponds to the width of the gate-off section indicated by the first intermediate dimming level.

2. The display device of claim 1, wherein the second width is greater than the first width.

3. The display device of claim 1, wherein:

in response to each of dimming levels between the first reference dimming level and the second reference dimming level, the controller configures the plurality of frames by combining at least one first frame and at least one second frame, the at least one first frame is a frame in which the width of the gate-off section of the emission control signal is determined as the first width, and the at least one second frame is a frame in which the width of the gate-off section of the emission control signal is determined as the second width.

4. The display device of claim 3, wherein in a range of the dimming levels between the first reference dimming level and the second reference dimming level, as the dimming levels increase, a number of first frames among the plurality of frames decreases and a number of second frames among the plurality of frames increases.

5. The display device of claim 3, wherein a sum of a number of the first frames and a number of the second frames included in the plurality of frames is constant.

6. The display device of claim 3, wherein:

in response to the dimming signal in which the information on the dimming level is the first intermediate dimming level, the controller arranges the at least one first frame and the at least one second frame in the plurality of frames according to a predetermined order.

7. The display device of claim 1, wherein the first width is k (where k is a multiple of 4) horizontal periods, and the second width is (k+4) horizontal periods.

8. The display device of claim 1, wherein a number of frames constituting the plurality of frames is a multiple of 4.

9. The display device of claim 1, wherein the plurality of frames constitutes one dimming cycle.

10. The display device of claim 9, wherein the dimming cycle is 4 frames.

11. The display device of claim 1, wherein:

the emission driver simultaneously supplies the emission control signal to a (2n−1)th (where n is an integer greater than zero) pixel row and a (2n)th pixel row among the plurality of pixel rows.

12. The display device of claim 11, further comprising a scan driver configured to sequentially supply the scan signal to the (2n−1)th pixel row and the (2n)th pixel row through the plurality of scan lines.

13. A method of driving a display device comprising:

determining a first width of a gate-off section of an emission control signal indicated by a first reference dimming level and a second width of the gate-off section of the emission control signal indicated by a second reference dimming level; and determining a width of the gate-off section of the emission control signal in at least some of a plurality of frames as the first width, and the width of the gate-off section of the emission control signal in a rest of the plurality of frames as the second width in response to a dimming signal of a first intermediate dimming level that is between the first reference dimming level and the second reference dimming level, wherein an average of the widths of all gate-off sections of the emission control signal per frame in the plurality of frames corresponds to the width of the gate-off section indicated by the first intermediate dimming level.

14. The method of driving the display device of claim 13, further comprising:

arranging a combination of one or more first frames and one or more second frames among the plurality of frames according to a predetermined order, wherein the first frame is a frame in which the width of the gate-off section of the emission control signal is determined as the first width, and the second frame is a frame in which the width of the gate-off section of the emission control signal is determined as the second width.

15. The method of driving the display device of claim 13, further comprising:

outputting the emission control signal corresponding to a dimming level of the dimming signal.

* * * * *